US009586157B2

(12) United States Patent
Garcia

(10) Patent No.: US 9,586,157 B2
(45) Date of Patent: Mar. 7, 2017

(54) PIÑATA TOY

(71) Applicant: Marco A. Garcia, Menlo Park, CA (US)

(72) Inventor: Marco A. Garcia, Menlo Park, CA (US)

(73) Assignee: Marco A. Garcia, Menlo Park, CA (US)

( * ) Notice: Subject to any disclaimer, the term of this patent is extended or adjusted under 35 U.S.C. 154(b) by 0 days.

(21) Appl. No.: 13/794,673

(22) Filed: Mar. 11, 2013

(65) Prior Publication Data

US 2013/0237117 A1 Sep. 12, 2013

Related U.S. Application Data

(60) Provisional application No. 61/609,151, filed on Mar. 9, 2012.

(51) Int. Cl.
*A63H 33/00* (2006.01)
*A63H 37/00* (2006.01)

(52) U.S. Cl.
CPC ..... *A63H 37/00* (2013.01)

(58) Field of Classification Search
USPC ..... 446/4, 5, 75
See application file for complete search history.

(56) References Cited

U.S. PATENT DOCUMENTS 1,108,005 A * 8/1914 Rey ..... 206/256
1,730,898 A * 10/1929 Percival ..... 383/38
3,032,345 A * 5/1962 Lemelson ..... 273/348.4
3,370,853 A * 2/1968 Feld et al. ..... 473/573
3,702,675 A * 11/1972 Bajo ..... B65D 5/425 206/457
3,854,239 A * 12/1974 Williams ..... A63J 19/00 15/231
4,015,364 A 4/1977 Oquita
4,167,078 A * 9/1979 Oquita ..... A63H 37/00 446/5
4,208,832 A * 6/1980 Corriveau ..... A63H 3/02 428/100
4,671,514 A * 6/1987 Wilson-Diehl ..... 273/287
4,787,872 A * 11/1988 Bajo ..... A63H 37/00 428/16
4,789,161 A * 12/1988 Waskelo ..... 473/514
(Continued)

*Primary Examiner* — Melba Bumgarner
*Assistant Examiner* — Urszula M Cegielnik
(74) *Attorney, Agent, or Firm* — Kali Law Group, P.C.

(57) ABSTRACT

Reusable piñata toys are presented including: an upper panel bounded by a collapsible frame member, where the collapsible frame member forms an upper edge; a lower panel bounded by a collapsible frame member, where the lower panel is disposed substantially parallel with the upper panel, and where the collapsible frame member forms a lower edge; a number of inner panels disposed substantially perpendicular with the upper panel and lower panel for mechanically coupling the upper panel and the lower panel, where the number of inner panels form a number of chambers, where the number of inner panels form a number of outer edges, and where the number of chambers are configured for receiving a number of small items; a number of holding flaps disposed along the lower edge; and a number of holding flaps disposed along the number of outer edges.

13 Claims, 4 Drawing Sheets

(56) References Cited

U.S. PATENT DOCUMENTS 4,834,687 A * 5/1989 Elam ..... A63H 33/00 273/DIG. 30
4,883,441 A * 11/1989 Byer ..... A63H 3/16 428/100
4,964,832 A * 10/1990 Bickoff ..... A63H 3/14 24/306
5,011,150 A * 4/1991 Averill ..... 473/284
5,123,655 A * 6/1992 Rones ..... 473/573
5,141,465 A * 8/1992 Stellman ..... A63F 9/305 273/447
5,195,917 A * 3/1993 Russell et al. ..... A63H 3/16 428/100
5,213,324 A * 5/1993 Bowers ..... A63B 69/0002 273/DIG. 30
5,244,266 A * 9/1993 Maldanis ..... 312/116
5,318,294 A * 6/1994 Boroski ..... 473/505
5,536,194 A * 7/1996 Larsen et al. ..... 446/5
5,620,325 A * 4/1997 Glick ..... A63H 33/04 434/258
5,765,831 A * 6/1998 Huffhines ..... 273/348.4
5,824,378 A * 10/1998 Armendariz et al. ..... B65D 81/368 428/16
5,878,907 A * 3/1999 Graf ..... 220/324
5,947,786 A * 9/1999 Glick ..... 446/85
5,988,017 A * 11/1999 Franklin et al. ..... 81/3.55
6,058,808 A * 5/2000 Williams et al. ..... 81/3.55
6,059,708 A * 5/2000 Armendariz et al. ..... 493/223
6,135,388 A * 10/2000 Hostetter ..... A63H 27/08 244/153 A
6,354,904 B1 * 3/2002 Grey ..... A63H 37/00 446/487
6,648,713 B1 * 11/2003 Oquita ..... A63H 37/00 446/487
6,964,593 B1 * 11/2005 Stevens ..... A63H 33/3072 434/393
7,063,397 B2 * 6/2006 Sabounjian ..... 312/6
7,377,692 B1 * 5/2008 Troncoso et al. ..... 383/110
7,442,106 B1 * 10/2008 Menow ..... A63H 37/00 446/365
7,648,059 B2 * 1/2010 Pavlu, Jr. ..... A63H 37/00 229/116.1
7,815,372 B2 * 10/2010 Stanton et al. ..... 383/104
8,469,228 B2 * 6/2013 Adams ..... 221/120
2004/0226850 A1 * 11/2004 Behnke ..... B65D 5/3628 206/514
2005/0023281 A1 * 2/2005 Bradford ..... B65D 25/08 220/528
2009/0101641 A1 * 4/2009 Fu ..... B65D 21/086 220/7
2009/0255935 A1 * 10/2009 Vargo ..... B65D 25/16 220/495.04
2010/0031895 A1 * 2/2010 Pierpont ..... 119/499
2010/0308053 A1 * 12/2010 Wisecarver et al. ..... 220/315
2011/0127289 A1 * 6/2011 Workman ..... 221/282

* cited by examiner

PIÑATA TOY

PRIORITY CLAIM TO PROVISIONAL APPLICATION

A claim for priority is hereby made under the provisions of 35 U.S.C. §119 for the present application based upon U.S. Provisional Application No. 61/609,151 filed on Mar. 9, 2012 which is incorporated herein by reference.

BACKGROUND

Piñatas are devices that are traditionally used to distribute treats at a children's party. There are two types of piñatas that are typically used. The first most widely used piñata is one that includes a hollow shape (such as an animal or decoration) having an outer shell made of cardboard or paper and glue, which is filled with treats. The object is to hit the piñata with a stick until the outer shell is broken and all the treats have exited the piñata. The second most used piñata is one that includes a hollow shape (such as an animal or decoration) having an outer shell and a bottom door having a lever that actuates the bottom door. There may be many strings attached to the bottom of this piñata but only one string is attached to the bottom door or lever which, when pulled, releases the contents of the piñata. One problem associated with the first example is the danger created by swinging a hard stick to strike and break the piñata. In many cases, bystanders have been injured when the hard stick is swung out of control. In attempting to alleviate this problem, the second example takes away the excitement from the tradition and simply is not as fun for the participants.

Other types of conventional piñatas have been created that require a frangible material or lever/door to release the gifts/candy from the piñata. In some other examples a telescopic structure may be utilized to collapse the piñata. In order to create a safe piñata while maintaining the fun of the experience, piñata toys are presented herein

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, reusable piñata toys are presented including: an upper panel bounded by a first collapsible frame member, where the first collapsible frame member forms an upper edge; a lower panel bounded by a second collapsible frame member, where the lower panel is disposed substantially parallel with the upper panel, and where the second collapsible frame member forms a lower edge; a number of inner panels disposed substantially perpendicular with the upper panel and lower panel for mechanically coupling the upper panel and the lower panel, where the number of inner panels form a number of chambers, where the number of inner panels form a number of outer edges, and where the number of chambers are configured for receiving a number of small items; a first number of holding flaps disposed along the lower edge; a second number of holding flaps disposed along the number of outer edges; and a number of releasable chamber covers each releasably attached along the first number of holding flaps and the second number of holding flaps such that the number of chambers are closed along at least three sides of the releasable chamber cover when attached. In some embodiments, reusable piñata toys further include: a piñata stick for striking the piñata toy, where the piñata stick includes, a distal end having at least one contact area, the contact area configured for releasably coupling with the releasable chamber cover such that a pulling force is exerted on the releasable chamber cover sufficient to remove the releasable chamber cover from either the first number of holding flaps and the second number of holding flaps, and a proximal end for grasping the piñata stick. In some embodiments, reusable piñata toys further include: a transparent lower slip cover disposed over the lower panel and forming a lower chamber for receiving a second insert.

In other embodiments, methods for of utilizing a reusable piñata toys are presented including: receiving the reusable piñata toy, the reusable piñata toy including, an upper panel bounded by a first collapsible frame member, where the first collapsible frame member forms an upper edge, a lower panel bounded by a second collapsible frame member, where the lower panel is disposed substantially parallel to the upper panel, and where the second collapsible frame member forms a lower edge, a number of inner panels disposed substantially perpendicular with the upper panel and lower panel for mechanically coupling the upper panel and the lower panel, where the number of inner panels form a number of chambers, where the number of inner panels form a number of outer edges, and where the number of chambers are configured for receiving a number of small items, a first number of holding flaps disposed along the lower edge, a second number of holding flaps disposed along the number of outer edges; filling the reusable piñata toy with a number of small items; and securing a number of releasable chamber covers each releasably attached along the first number of holding flaps and the second number of holding flaps such that the number of chambers are closed along at least three sides of the releasable chamber cover when attached. In some embodiments, methods further include: hanging the reusable piñata toy; and hitting the reusable piñata toy with a piñata stick, where the piñata stick includes, a distal end having at least one contact area, the contact area configured for releasably coupling with the releasable chamber cover such that a pulling force is exerted on the releasable chamber cover sufficient to remove the releasable chamber cover from either the first number of holding flaps and the second number of holding flaps, and a proximal end for grasping the stick.

In other embodiments, reusable piñata toys are presented including: a toy body having at least one cavity; an upper panel disposed along an upper surface of the at least one cavity and forming an upper edge; a lower panel disposed along a lower surface of the at least one cavity and forming a lower edge, where the lower panel is disposed substantially parallel with the upper panel; a number of inner panels disposed substantially perpendicular with the upper panel and lower panel for mechanically coupling the upper panel and the lower panel, where the number of inner panels form at least one chamber, where the number of inner panels form a number of outer edges, and where the at least one chamber is configured for receiving a number of small items; a first number of holding flaps disposed along the lower edge; a second number of holding flaps disposed along the number of outer edges; and a number of releasable chamber covers each releasably attached along the first number of holding flaps and the second number of holding flaps such that the at least one chamber is closed along at least three sides of the releasable chamber cover when attached. In some embodiments, reusable piñata toys further include: a piñata stick for striking the piñata toy, where the piñata stick includes, a distal end having at least one contact area, the contact area configured for releasably coupling with the releasable chamber cover such that a pulling force is exerted on the releasable chamber cover sufficient to remove the releasable chamber cover from either the first number of holding flaps and the second number of holding flaps, and a proximal end for grasping the piñata stick.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
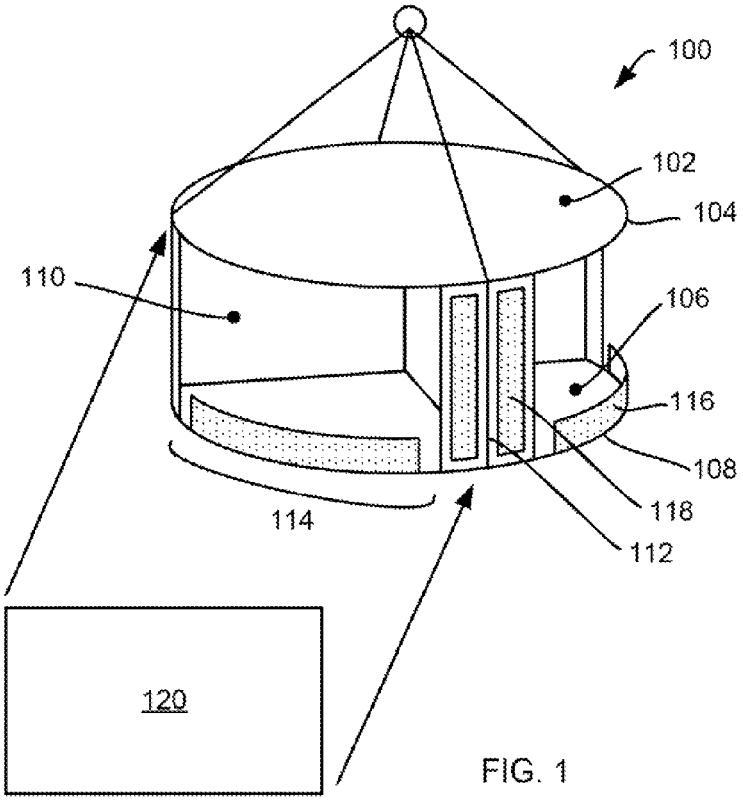
FIG. 1 is an illustrative representation of an orthogonal view of a reusable piñata toy in accordance with embodiments of the present invention.

FIG. 1 is an illustrative representation of an orthogonal view of a reusable piñata toy 100 in accordance with embodiments of the present invention. As illustrated, piñata toy 100 includes upper panel 102 bounded by collapsible frame member that forms upper edge 104. In some embodiments, collapsible frame members may be formed from a semi-flexible polymeric rod. In utilizing a semi-flexible polymeric rod for frame members, piñata toy embodiments provided herein may be collapsed by a twisting and folding motion. It may be appreciated that collapsible piñata toys may provide space saving requirements when not in use. Further illustrated is lower panel 106 bounded by collapsible frame member that forms lower edge 108. As illustrated, lower panel 106 is disposed substantially parallel with upper panel 102. Further illustrated are inner panels 110. In embodiments, inner panels may be disposed in any number of ways without departing from the present invention. Various inner panel configurations and upper and lower panel shapes will be discussed in further detail below for FIG. 4. As may be seen, inner panel 110 may be disposed substantially perpendicular with upper panel 102 and lower panel 106 to mechanically couple upper panel 102 with lower panel 106. It may be further seen that inner panels form chamber 114 and include outer edge 112. It may be appreciated that chambers may receive any number of small items (not shown) for dispersal without departing from embodiments provided herein.

To cover the chambers, releasable chamber cover 120 is provided. In embodiments, releasable chamber covers may be composed of a material such as a non-woven cloth, a felt, a wool felt, a polyester felt, and a loop material without limitation. Releasable chamber cover embodiments may be sized to fully or partially cover chamber without limitation. In order to attach releasable chamber cover 120 with piñata toy 100, a number of holding flaps are provided. In embodiments, holding flaps may include a releasable attachment element such as a hook material or a number of snaps without limitation. As such, a number of holding flaps 116 may be disposed along lower edge 108. In addition, a number of holding flaps 118 may be disposed along outer edge 112. In this manner, chamber 114 may be closed along at least three sides of releasable chamber cover 120. It may be appreciated in embodiments, that when three sides of releasable chamber cover are attached and one side of releasable chamber cover is unattached to create an opening, small items such as small toys, curios, candy, novelties, and the like may be randomly dispersed through the opening when struck by a piñata stick. Randomly releasing small items during play may be desirable to increase enjoyment of the game. In other embodiments, a number of holding flap (not shown) may be disposed along upper edge 104 so that the chambers are closed along at least four sides of the releasable chamber cover when attached. It may be appreciated that while illustrated chamber covers are rectangular, any number of configurations or shapes may be utilized without departing from embodiments herein. As such, the particular shape and configuration of the chamber covers should not be construed as limiting with respect to shape, size, or dimension.

Figure 2:
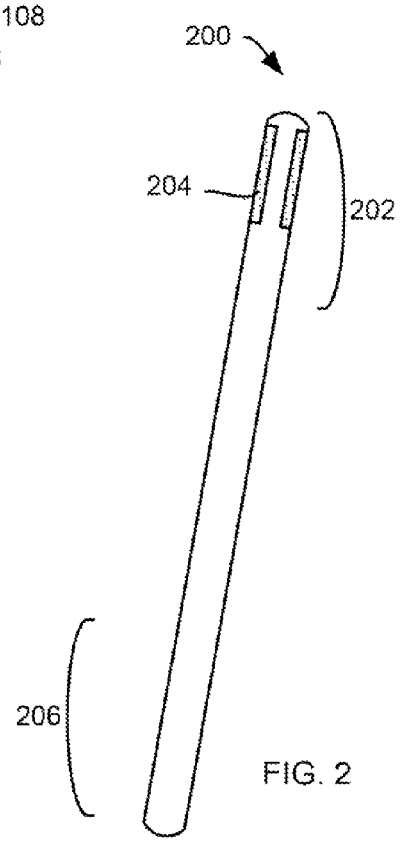
FIG. 2 is an illustrative representation of a piñata stick in accordance with embodiments of the present invention.

FIG. 2 is an illustrative representation of a piñata stick 200 in accordance with embodiments of the present invention. It may be appreciated that a piñata toy must be struck with a piñata stick in order to release any small items in the piñata toy. Thus, piñata stick 200 includes distal end 202 having contact area 204. In embodiments, contact area 204 may be configured for releasably coupling with releasable chamber cover 120 such that a pulling force is exerted on releasable chamber cover 120 sufficient to remove 120 releasable chamber cover from either of holding flaps 116 or holding flaps 118. In embodiments, contact areas may be a material such as a hook material, a gum material, and a double-sided adhesive tape material without limitation. Thus, in operation, when a person strikes the piñata toy with a piñata stick, small items may be released randomly from the opening in the chamber. Furthermore, when the piñata stick's contact area comes into contact with releasable chamber cover, the contact area may temporarily and releasably adhere with the releasable chamber cover. As the person follows through with the piñata stick, a portion or all of the releasable chamber cover may be released from the piñata toy releasing a portion or all of the small items in that particular chamber.

Further illustrated, piñata stick 200 may include proximal end 206 for grasping piñata stick 200. Proximal end embodiments may include any number of shapes or configurations without departing from embodiments provided herein such as a grip shaped handle, or a ring handle. Furthermore, proximal ends may be coated with a gripping agent such as gripping tape or gripping adhesive without departing from embodiments provided herein. In order to assure safety, piñata stick embodiments may include a soft, semi-flexible material forming an elongated shaft, which may be manufactured from a variety of materials without limitation. In other embodiments, piñata sticks may include an inflatable chamber forming an elongated shaft without limitation. Because releasable chamber covers are released by a pulling action, a soft piñata stick that provides a safer environment may be utilized. However, it may be noted that a hard piñata stick having contact areas may still be utilized. In one variation a piñata stick with contact areas and a piñata stick having no contact areas may be utilized in tandem to increase the time the piñata toy may be struck without opening. In those embodiments, random dispersal of small items may contribute to a long lasting and enjoyable gaming experience.

Figure 3:
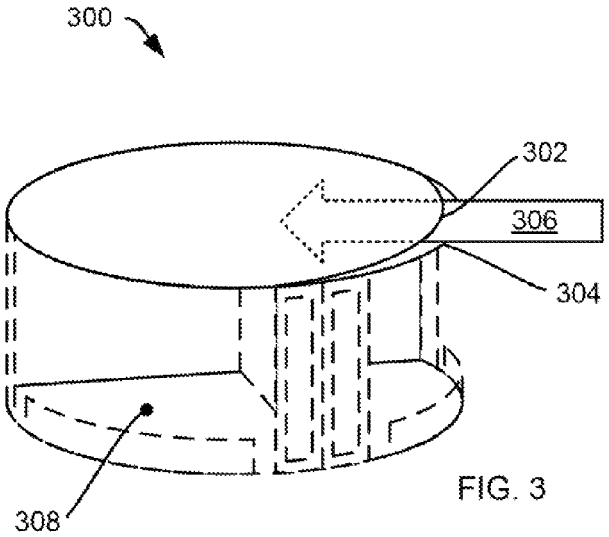
FIG. 3 is an illustrative representation of top view of a reusable piñata toy having a slip cover in accordance with embodiments of the present invention.

FIG. 3 is an illustrative representation of top view of a reusable piñata toy 300 having a slip cover 302 in accordance with embodiments of the present invention. As illustrated, piñata toy 300 may include transparent upper slip cover 302 disposed over upper panel 304 and forming an upper chamber for receiving an insert as illustrated by arrow 306. It may be desirable, in some examples, to personalize a piñata toy with artwork directed to a particular user. For example, a birthday greeting or photo may be inserted to add to the user's enjoyment without limitation and without departing from embodiments provided herein. In other embodiments, directed advertising inserts may be utilized without limitation. In like manner, piñata toy 300 may further include a transparent lower slip cover (not shown) disposed over lower panel 308 and forming a lower chamber for receiving an insert.

Figure 4:
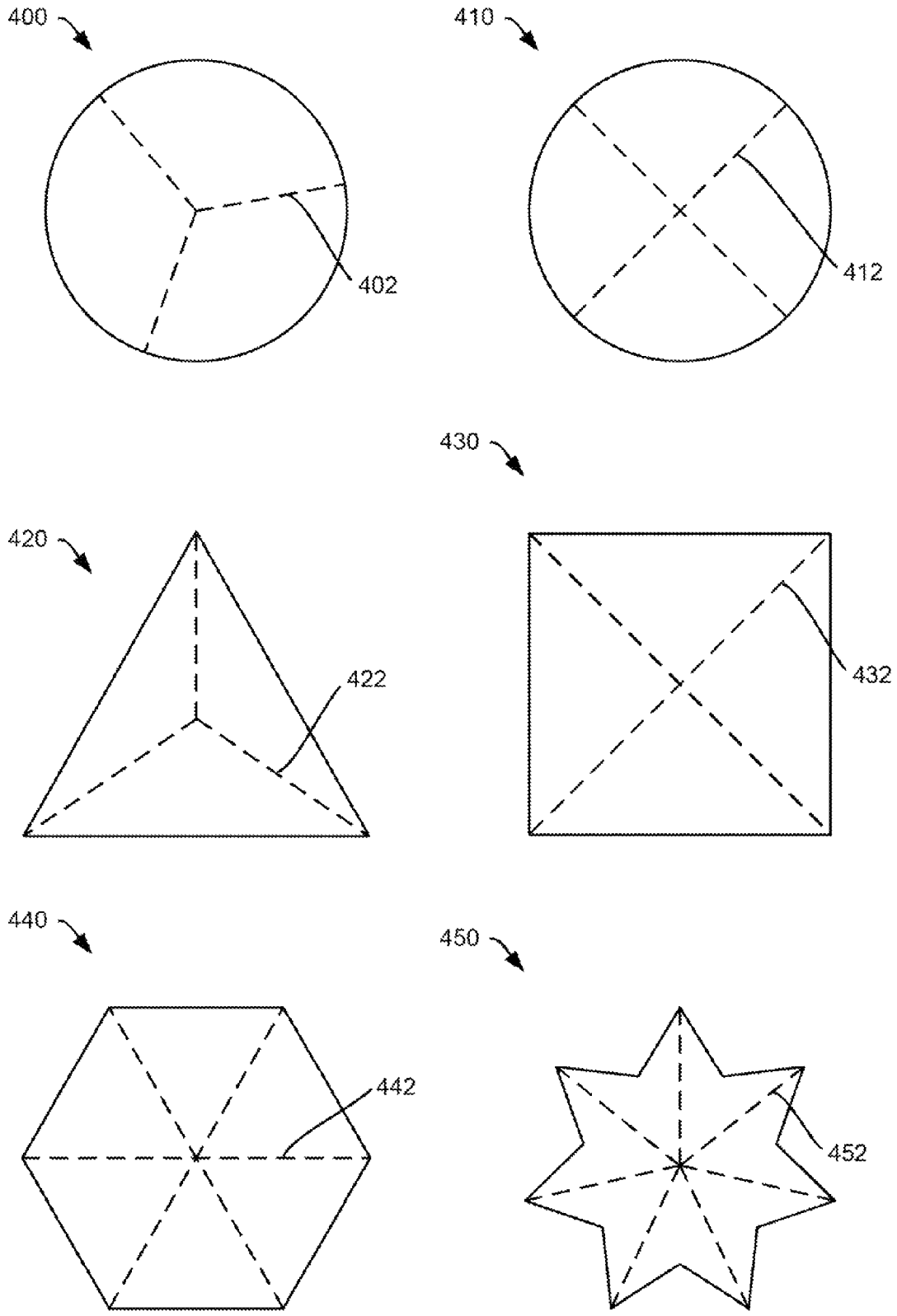
FIG. 4 is an illustrative representation of various configurations and geometric shapes of piñata toys in accordance with embodiments of the present invention.

FIG. 4 is an illustrative representation of various configurations and geometric shapes of piñata toys in accordance with embodiments of the present invention. It may be noted that the various configurations and shapes illustrated are for use in clarifying various embodiments and should not be construed as limiting with respect to shape, size, and configuration. For example, in an embodiment, piñata toy 400 forms a circle having three chambers formed by inner panels 402. In another embodiment, piñata toy 410 forms a circle having four chambers formed by inner panels 412. In another embodiment, piñata toy 420 forms a triangle having three chambers formed by inner panels 422. In another embodiment, piñata toy 430 forms a square having four chambers formed by inner panels 432. In another embodiment, piñata toy 440 forms a hexagon having six chambers formed by inner panels 442. Still further, in another embodiment, piñata toy 450 forms a star having seven chambers formed by inner panels 452. As may be appreciated, many other shapes may be utilized in like manner without departing from embodiments provided herein. For example, in some embodiments, piñata toys may form a non-geometric shape such an animal or character shape having chambers formed by inner panels. Non-geometric shape embodiments will be discussed in further detail below for FIG. 6. In other embodiments, the embodiments illustrated may include additional decorative elements which may enhance a user's experience such as streamers, balloons, ties, bow, ribbons, or other shapes such as animal, character, or vehicle shapes.

Figure 5:
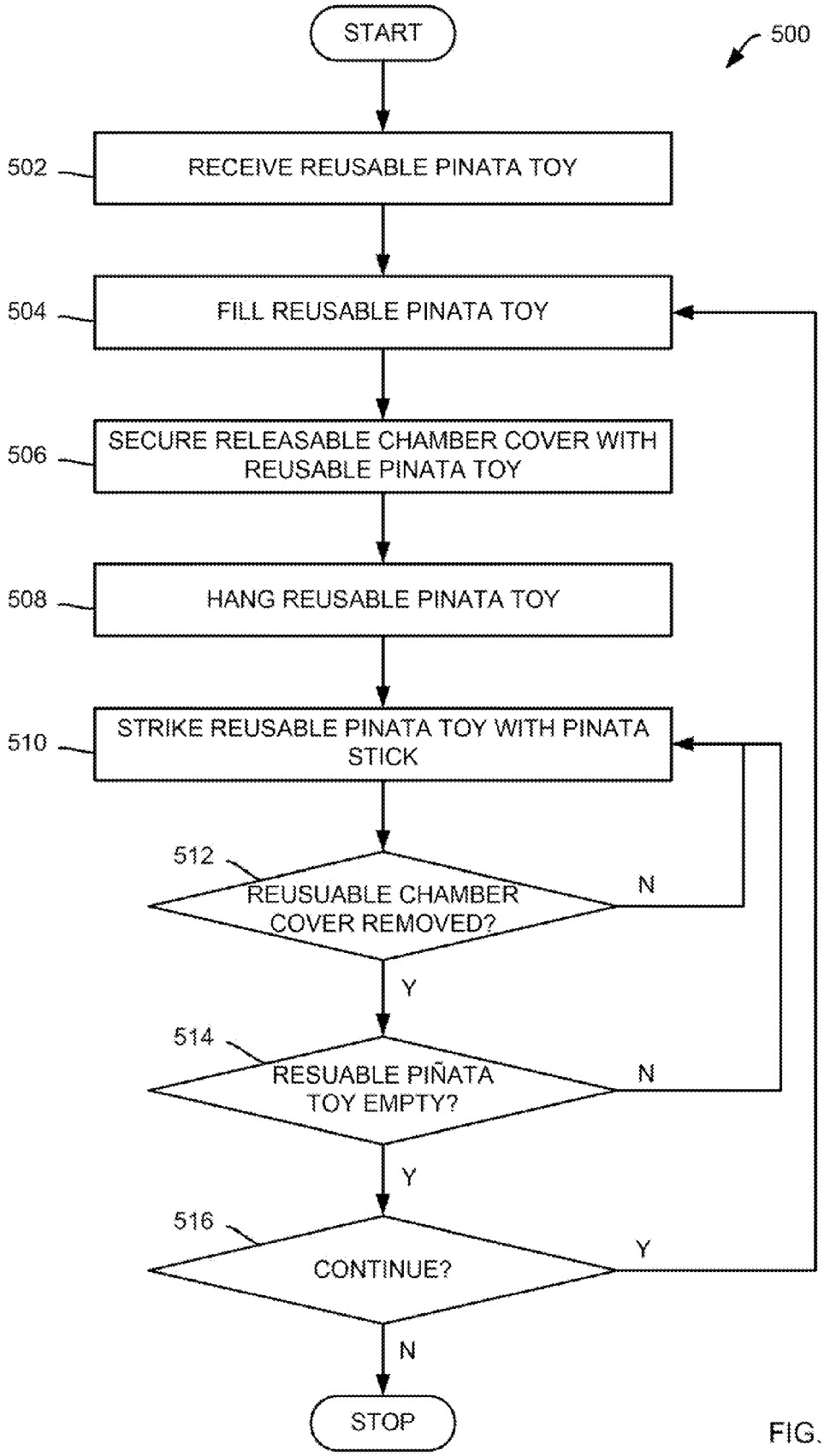
FIG. 5 is an illustrative flowchart for methods of utilizing reusable piñata toys in accordance with embodiments of the present invention.

FIG. 5 is an illustrative flowchart 500 for methods of utilizing reusable piñata toys in accordance with embodiments of the present invention. At a first step 502, a reusable piñata toy, in accordance with embodiments disclosed herein, is received. At a next step 504, the reusable piñata toy is filled with any number of small items, which small items may include, for example, small toys, curios, candy, novelties, and the like. At a next step 506, the method secures releasable chamber covers with the reusable piñata toy along holding flaps along at least three sides of the releasable chamber covers. As noted above, when three sides of releasable chamber covers are secured, an opening is formed to allow random dispersal of small items. In some embodiments, the method may secures releasable chamber covers to the reusable piñata toy along holding flaps along at least four sides of the releasable chamber covers.

At a next step 508, the method hangs the reusable piñata toy. Hanging may be accomplished by any method known in the art without departing from embodiments provided herein. As illustrated in FIG. 1, a number of attachment points may receive a line or cord with which to hang reusable piñata toy embodiments. In some examples, reusable piñata toys may be suspended in a manner to allow the piñata toy to be raised and lowered during play to make the hitting more or less difficult. At a next step, 510, the method strikes the reusable piñata toy with a piñata stick embodiment as disclosed herein. As noted above, in some embodiments, striking piñata toy embodiments may randomly release at least some of the small items disposed in the piñata toy chamber. Randomly releasing small items during play may be desirable to increase enjoyment of the game. At a next step 512, the method determines whether the removable chamber cover has been removed. If the method determines at a step 512, that the removable chamber cover has not been removed, the method returns to a step 510 to strike the reusable piñata toy. If the method determines at a step 512, that the removable chamber cover has been removed, small items may be dispensed whereupon the method continues to a step 514 to determine whether the reusable piñata toy is empty. If the method determines at a step 514, that the reusable piñata toy is not empty, the method returns to a step 510 to strike the reusable piñata toy. If the method determines at a step 514, that the reusable piñata toy is empty, the method continues to a step 516 to determine whether to continue. If the method determines at a step 516 to continue, the method returns to a step 504 to refill the reusable piñata toy with small items. If the method determines at a step 516 to not continue, the method ends.

Alternate Embodiments

Figure 6:
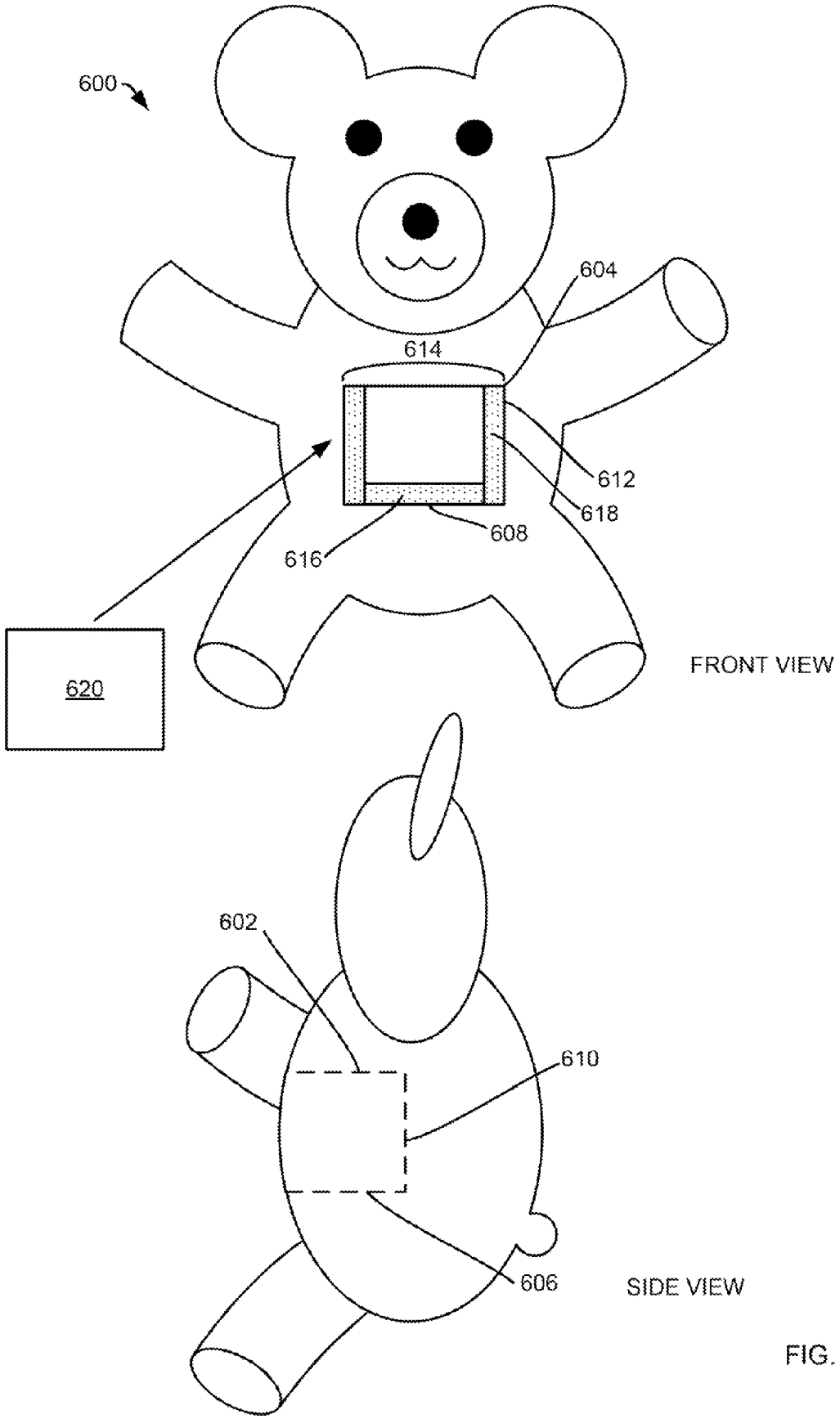
FIG. 6 is an illustrative representation of a reusable piñata toy in accordance with embodiments of the present invention.

FIG. 6 is an illustrative representation of a reusable piñata toy 600 in accordance with embodiments of the present invention. As illustrated, piñata toy 600 includes toy body 630 that includes at least one cavity formed by a number of elements. It may be appreciated that the toy body illustrated is for use in clarifying embodiments provided herein and should not be construed as limiting with respect to size, shape, or number of cavities. Thus, any number of shapes and sizes may be utilized without departing from embodiments herein. Further any number of cavities may be utilized without departing from embodiments provided herein. As illustrated, upper panel 602 that forms upper edge 604 and is disposed along an upper surface of the cavity. Further illustrated is lower panel 606 that forms lower edge 608 and is disposed along a lower surface of the cavity. As illustrated, lower panel 606 is disposed substantially parallel with upper panel 602. Further illustrated are inner panels 610. In embodiments, inner panels may be disposed in any number of ways without departing from the present invention. As may be seen, inner panel 610 may be disposed substantially perpendicular with upper panel 602 and lower panel 606 to mechanically couple upper panel 602 with lower panel 606. It may be further seen that inner panels form chamber 614 and include outer edge 612. It may be appreciated that chambers may receive any number of small items (not shown) for dispersal without departing from embodiments provided herein.

To cover the chambers, releasable chamber cover 620 is provided. In embodiments, releasable chamber covers may be composed of a material such as a non-woven cloth, a felt, a wool felt, a polyester felt, and a loop material without limitation. Releasable chamber cover embodiments may be sized to fully or partially cover chamber without limitation. In order to attach releasable chamber cover 620 with piñata toy 600, a number of holding flaps are provided. In embodiments, holding flaps may include a releasable attachment element such as a hook material or a number of snaps without limitation. As such, a number of holding flaps 616 may be disposed along lower edge 608. In addition, a number of holding flaps 618 may be disposed along outer edge 612. In this manner, chamber 614 may be closed along at least three sides of releasable chamber cover 620. It may be appreciated in embodiments, that when three sides of releasable chamber cover are attached and one side of releasable chamber cover is unattached to create an opening, small items such as small toys, curios, candy, novelties, and the like may be randomly dispersed through the opening when struck by a piñata stick. Randomly releasing small items during play may be desirable to increase enjoyment of the game. In other embodiments, a number of holding flap (not shown) may be disposed along upper edge 604 so that the chambers are closed along at least four sides of the releasable chamber cover when attached. It may be appreciated that while illustrated chamber covers are rectangular, any number of configurations or shapes may be utilized without departing from embodiments herein. As such, the particular shape and configuration of the chamber covers should not be construed as limiting with respect to shape, size, or dimension.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A method of utilizing a reusable piñata toy comprising:

receiving the reusable piñata toy, the reusable piñata toy including, an upper panel bounded by a first collapsible frame member, wherein the first collapsible frame member forms an upper edge, a lower panel bounded by a second collapsible frame member, wherein the lower panel is disposed substantially parallel to the upper panel, and wherein the second collapsible frame member forms a lower edge, a plurality of inner panels disposed substantially perpendicular with the upper panel and lower panel for mechanically coupling the upper panel and the lower panel, wherein the plurality of inner panels form a plurality of chambers, wherein the plurality of inner panels form a plurality of outer edges, and wherein the plurality of chambers are configured for receiving a plurality of small items, a first plurality of holding flaps disposed along the lower edge, a second plurality of holding flaps disposed along the plurality of outer edges, wherein the first and second plurality of holding flaps include a releasable attachment element along an outer surface of the holding flaps;

securing a plurality of releasable chamber covers each releasably attached along the first plurality of holding flaps and the second plurality of holding flaps such that the plurality of chambers are releasably secured along at least three sides of the releasable chamber cover when attached, wherein an upper edge of each of the plurality of releasable chamber covers remains open to release some of the plurality of small items when the reusable piñata is struck, and wherein the releasable chamber cover is a flexible fabric; and filling the reusable piñata toy with a plurality of small items hanging the reusable pinata toy;

hitting the reusable pinata toy with a pinata stick, wherein the pinata stick includes, a distal end having a contact area positioned solely around a circumference of an elongated shaft of the pinata stick, the contact area configured for releasably coupling with the releasable chamber cover such that a pulling force is exerted on the releasable chamber cover sufficient to remove the releasable chamber cover from either the first plurality of holding flaps and the second plurality of holding flaps, and a proximal end for grasping the stick;

releasing the releasable chamber cover; and dispensing the small items.

2. The method of claim 1, further comprising:

refilling the reusable piñata toy with additional small items.

3. The method of claim 1, wherein releasable attachment element is selected from the group consisting of: a hook material, and a plurality of snaps.

4. The method of claim 1, wherein the releasable chamber cover is composed of a material selected from the group consisting of: a non-woven cloth, a felt, a wool felt, a polyester felt, and a loop material.

5. The method of claim 1 wherein the contact area is a material selected from the group consisting of: a hook material, a gum material, and a double-sided adhesive tape material.

6. The method of claim 1, wherein the piñata stick comprises a soft, semi-flexible material forming an elongated shaft.

7. The method of claim 1, wherein the piñata stick comprises an inflatable chamber forming an elongated shaft.

8. The method of claim 1, further comprising:

receiving a first insert; and inserting the first insert into a transparent upper slip cover disposed over the upper panel and forming an upper chamber for receiving the first insert.

9. The method of claim 8, further comprising:

receiving a second insert; and inserting the second insert into a transparent lower slip cover disposed over the lower panel and forming a lower chamber for receiving the second insert.

10. The method of claim 1, further comprising:

securing the plurality of releasable chamber covers each along a third plurality of holding flaps disposed along the upper edge such that the plurality of chambers are closed along four sides of the releasable chamber cover when attached.

11. The method of claim 1, wherein the upper panel and the lower panel form a geometric shape selected from the group consisting of: a circle, a triangle, a square, a rectangle, a polygon, and a star.

12. The method of claim 1, wherein the first collapsible frame member and second collapsible frame member comprise a semi-flexible polymeric rod.

13. The method of claim 1, wherein the small items are selected from the group consisting of: small toys, curios, candy, and novelties.

* * * * *